United States Patent [19]

Brandell

[11] 4,246,964

[45] Jan. 27, 1981

[54] DOWN HOLE PUMP AND TESTING APPARATUS

[75] Inventor: John T. Brandell, Duncan, Okla.

[73] Assignee: Halliburton Company, Duncan, Okla.

[21] Appl. No.: 57,093

[22] Filed: Jul. 12, 1979

[51] Int. Cl.[3] ..... E21B 43/00; E21B 33/127

[52] U.S. Cl. ..... 166/106; 166/187; 166/191

[58] Field of Search ..... 166/106, 187, 145; 92/33

[56] References Cited

U.S. PATENT DOCUMENTS

| | | | |
|---|---|---|---|
| 2,690,224 | 9/1954 | Roberts | 166/187 |
| 3,083,774 | 4/1963 | Peters et al. | 166/187 |
| 3,291,219 | 12/1966 | Nutter | 166/145 |
| 3,439,740 | 4/1969 | Conover | 166/187 |
| 3,926,254 | 12/1975 | Evans et al. | 166/106 |

*Primary Examiner*—James A. Leppink

*Attorney, Agent, or Firm*—John H. Tregoning; James R. Duzan; Lucian Wayne Beavers

[57] ABSTRACT

A downhole testing apparatus has a modular construction including a pump assembly, a screen assembly, a first packer assembly, an intake port assembly, and a second packer assembly. The pump assembly includes an improved ratchet assembly for opening and closing a relief port of a discharge passage of said pump. The pump assembly is constructed so that said ratchet assembly and the moving components of the pump are covered with a lubricating fluid contained between upper and lower seals.

10 Claims, 15 Drawing Figures

DOWN HOLE PUMP AND TESTING APPARATUS

This invention relates generally to down hole pumps and apparatus for testing a zone of a well.

The prior art includes several apparatus which perform the same general function as the present invention. Examples of such apparatus are disclosed in U.S. Pat. No. 3,926,254 to Evans, et al., assigned to the assignee of the present invention, and No. 3,439,740 to Conover.

The present invention basically comprises an improved version of the Evans, et al. device, which incorporates a rotary cam drive and piston pump assembly similar to that of Conover. The Evans, et al. device has been modified to allow the testing apparatus to break down into five modular components including, a pump assembly (FIGS. 1A–1C), a screen assembly (FIGS. 2A–2B), an upper first packer assembly (FIGS. 3A–3B), an intake port assembly (FIGS. 4A–4B), and a lower second packer assembly (FIGS. 5A–5C).

In the apparatus described in Evans, et al. U.S. Pat. No. 3,926,254, and in other similar prior art apparatus previously used by the assignee of the present invention, the components analogous to the pump assembly and screen assembly thereof have comprised a single modular unit. By the present invention, those components have been redesigned to comprise two modular units, namely the pump assembly (FIGS. 1A–1C), and the screen assembly (FIGS. 2A–2B).

Numerous other improvements have been made to the pump assembly, including a sealed lubrication system surrounding the screw jack assembly and the cam drive piston pump, and an improved sealing means on the pump pistons.

In the Evans, et al. apparatus and other similar prior art apparatus used by the assignee of the present invention, the components analogous to the upper first packer assembly and the intake port assembly have comprised a single modular unit. By the present invention, those components have also been redesigned to comprise two modular units, namely the upper first packer assembly (FIGS. 3A–3B) and the intake port assembly (FIGS. 4A–4B).

The lower second packer assembly (FIGS. 5A–5C) is the same as prior art apparatus previously used by the assignee of the present invention and of itself does not include any novel features.

FIGS. 1A–1C comprise a partly sectional elevation view of the pump assembly.

FIGS. 2A–2B comprise a partly sectional elevation view of the screen assembly.

FIGS. 3A–3B comprise a partly sectional elevation view of the upper first packer assembly.

FIGS. 4A–4B comprise a partly sectional elevation view of the intake port assembly.

FIGS. 5A–5C comprise a partly sectional elevation view of the lower second packer assembly.

The present invention is designed for use in a tool string similar to that shown in FIGS. 1–5 of U.S. Pat. No. 3,926,254 to Evans, et al., and the manner of operation of the present invention is similar to the manner of operation described in Evans, et al.

Figure 1B:
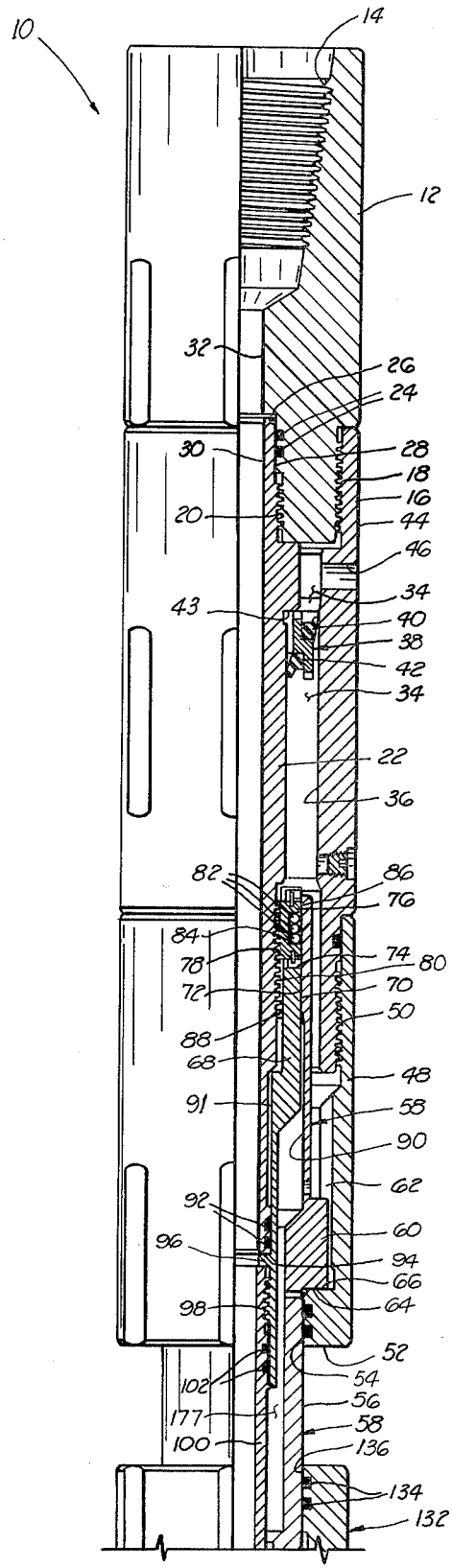
Figure 1A:
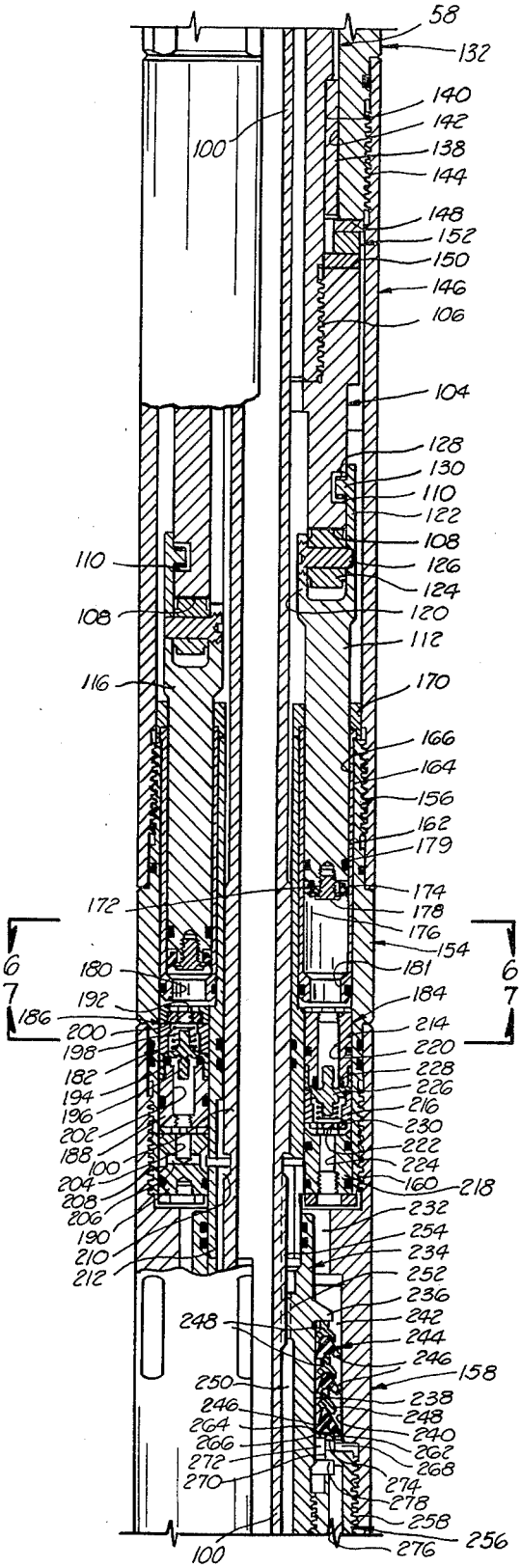

Referring now to the drawings and particularly to FIG. 1A, the down hole pump assembly of the present invention is shown and generally designated by the numeral 10.

The down hole pump assembly 10 includes a top adapter 12 having an internal threaded bore 14 which provides a means for connecting the top adapter 12 to those portions of a pipe or drill string 15 (See FIG. 8), located above down hole pump assembly 10.

Figure 8:
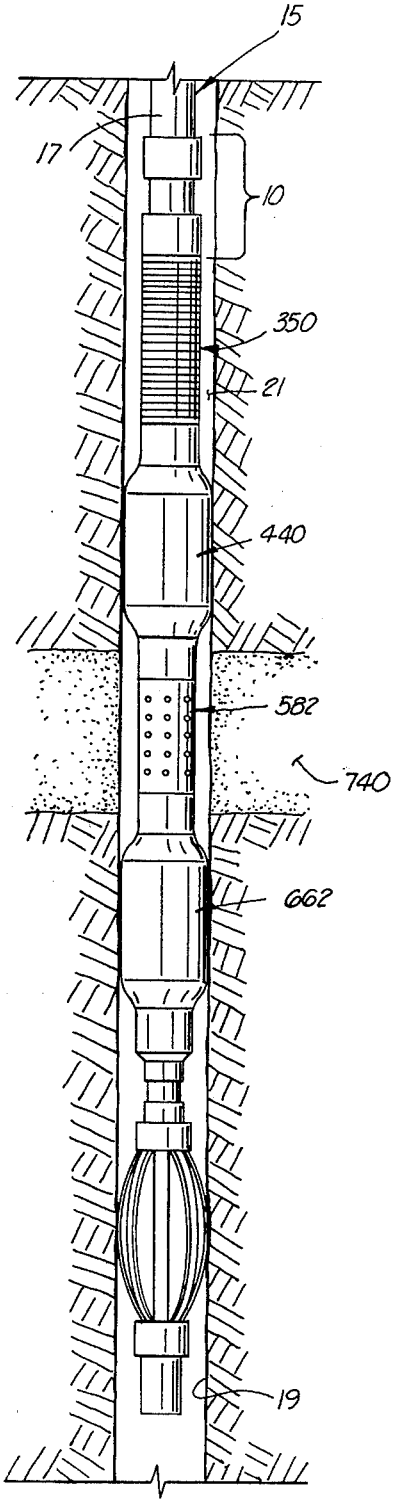
FIG. 8 is a schematic elevation view showing the down hole pump and testing apparatus of the present invention in place within a well hole.

The term "pipe string" is used to refer to the length of pipe 17 suspended from the surface of the well and all the tools such as pump assembly 10 which are attached to pipe 17. FIG. 8 shows the pipe string 15 in place within a well hole 19. An annular space 21 is defined between pipe string 15 and well hole 19. Annular space 21 generally contains a well fluid such as drilling mud.

A lower end of top adapter 12 is threadedly connected to a torque adapter 16 at threaded connection 18 therebetween.

The lower end of top adapter 12 includes an internal threaded portion 20 by means of which top adapter 12 is threadedly connected to a ratchet mandrel 22. A fluid tight seal is provided between top adapter 12 and ratchet mandrel 22 by means of O-ring seals 24, disposed in annular grooves located on an inner cylindrical surface 26 of top adapter 12, and sealingly engaging an outer cylindrical surface 28 of ratchet mandrel 22. Ratchet mandrel 22 includes an internal bore 30 which communicates with an internal bore 32 of top adapter 12.

An annular cavity 34 is located between ratchet mandrel 22 and internal bore 36 of torque adapter 16. An annular floating seal means 38 is disposed within annular cavity 34 and includes upper and lower sealing rings 40 and 42 which provide fluid tight seals against torque adapter 16 and ratchet mandrel 22, respectively.

The outer surface of torque adapter 16 and the inner bore 36 of torque adapter 16, engaged by floating seal 38, may be referred to as radially inner and outer surfaces, respectively, of annular cavity 34. Floating seal 38 separates the well fluid in annular cavity 21 from a lubricating fluid located in annular cavity 34 between floating seal 38 and a torque mandrel 58.

Floating seal 38 is adapted for axial movement within cavity 34 when subjected to a differential pressure across floating seal 38 within cavity 34, as will be further explained below.

Fluid communication is provided between the upper end of cavity 34 and the annular cavity 21, by a relief port means 46. Torque adapter 16 includes an outer cylindrical surface 44 which is exposed to the well fluid in annular cavity 21.

Ratchet mandrel 22 includes a downward facing shoulder 43 projecting into annular cavity 34 for engaging floating seal 38 and limiting longitudinal movement of floating seal 38 toward relief portion means 46. Upper sealing ring 40 provides a means for allowing a portion of the lubricating fluid located in annular cavity 34 to flow past floating seal 38 when torque mandrel 58 is moved longitudinally toward floating seal 38 after floating seal 38 is engaged with downward facing shoulder 43.

A lower end of torque adapter 16 is threadedly connected to a torque housing 48 at threaded connection 50. Torque housing 48 has radially inward extending flange 52 at its lower end which includes an internal bore 54 which closely receives an outer cylindrical surface 56 of torque mandrel 58.

Torque mandrel 58 includes a plurality of radially outward protruding splines 60 which mesh with a plurality of radially inward extending splines 62 of torque housing 48 so that relative axial movement between torque housing 48 and torque mandrel 58 is allowed while relative rotational movement between torque housing 48 and torque mandrel 58 is prevented. Upward axial movement of torque housing 48 relative to torque mandrel 58 is limited by engagement of a downward facing shoulder 64 of torque mandrel 58 with an upward facing shoulder 66 of torque housing 48.

A ratchet case 68 includes an upper outer cylindrical surface 70 which is closely received within an upper inner cylindrical surface 72 of torque mandrel 58.

Ratchet case 68 includes a plurality of ratchet member cavities 74 disposed through ratchet case 68. Within each of the ratchet member cavities 74 is contained a ratchet block 76. Each of the ratchet blocks 76 includes an inner left-handed ratchet thread 78 which engages a left-hand threaded portion 80 of ratchet mandrel 22.

A plurality of endless elastic bands 82 are placed about ratchet case 68 and retained in outer grooves 84 of ratchet blocks 76. Each of the ratchet blocks 76 has a radially outer surface 86 which closely engages upper inner cylindrical surface 72 of torque mandrel 58, so that the inner ratchet threads 78 of ratchet blocks 76 are retained in engagement with the threaded portion 80 of ratchet mandrel 22 as long as ratchet blocks 76 are engaged with inner cylindrical surface 72.

When ratchet mandrel 22 is rotated clockwise relative to ratchet case 68, as viewed from above, the ratchet case 68 is moved downward relative to ratchet mandrel 22. When ratchet case 68 is moved downward a sufficient amount the threads 78 of ratchet block 76 move past a bottom thread 88, so that ratchet case 68 is not moved any further downward as ratchet mandrel 22 continues to rotate relative to ratchet case 68.

After the ratchet block 76 is moved out of engagement with the threaded portion 80, the ratchet block 76 is adjacent to the upper end of an enlarged inner diameter portion 90 of ratchet case 68. When ratchet blocks 76 are located within enlarged inner diameter portion 90, it is possible for ratchet blocks 76 to move radially outward relative to threaded portion 80 so that threaded portion 80 may be ratcheted downward relative to ratchet blocks 76 without rotation relative thereto when weight is set down upon ratchet mandrel 22.

Ratchet case 68 includes a bore 91 within which a lower end 94 of ratchet mandrel 22 is received. Sealing fluid tight engagement is provided between ratchet mandrel 22 and ratchet case 68 by means of a plurality of O-rings 92 disposed in annular grooves about an outer surface of ratchet mandrel 22 adjacent lower end 94. A radially inward projecting ledge 96 of ratchet case 68 engages lower end 94 of ratchet mandrel 22 to limit downward movement of ratchet mandrel 22 relative to ratchet case 68.

A lower end of ratchet case 68 includes an internal threaded portion 98 which threadedly engages an upper end of a release mandrel 100. Fluid tight sealing engagement between ratchet case 68 and release mandrel 100 is provided by means of O-rings 102.

The lower end of torque mandrel 58 is connected to a pump cam drive assembly 104 at threaded connection 106 (See FIG. 1B). Cam drive assembly 104 is an annular shaped member including an annular lower cam drive surface 108 and an annular cam return groove 110. The cam groove 110 is parallel to the cam surface 108.

Engaging the cam surface 108 and cam groove 110 are four piston assemblies. Two of the piston assemblies, 112 and 116, are shown in FIG. 1B. The first piston 112 will be described. The other pistons are similarly constructed.

Piston assembly 112 includes inner and outer upper extensions 120 and 122 at its upper end. A cam-roller bearing 124 is mounted upon a cam follower pin 126 which spans inner and outer extensions 120 and 122.

A return follower bushing 128 is attached to a radially inward extension 130 of outer extension 122.

The cam-roller bearing rollingly engages cam surface 108 so as to drive the piston 112 downward as the low point of cam surface 108 moves past piston assembly 112. The return follower bushing 128 engages cam return groove 110 so as to pull piston assembly 112 upwards as the high point of cam groove 110 moves past the first piston assembly 112. This construction is similar to that shown in FIG. 16 of U.S. Pat. No. 3,439,740 to Conover.

A bearing retainer 132 is disposed about torque mandrel 58 and includes annular seal means 134 which provide sealing engagement between torque mandrel 58 and an upper inner bore 136 of bearing retainer 132.

An annular mandrel bushing 138 is closely received within an annular space between an outer surface 140 of torque mandrel 58 and an inner cylindrical surface 142, communicating with the lower end of bearing retainer 132.

The lower end of bearing retainer 132 includes an external threaded portion 144 which threadedly engages an upper inner portion of a piston housing 146.

Located between a lower end 148 of bearing retainer 132 and an upper end 150 of pump cam drive assembly 104 is a thrust bearing 152. The thrust bearing 152 carries the weight of those components suspended from piston housing 146.

A lower end of piston housing 146 is connected to a valve body 154 at threaded connection 156. A lower end of valve body 154 is connected to a valve casing 158 at threaded connection 160.

Figure 6:
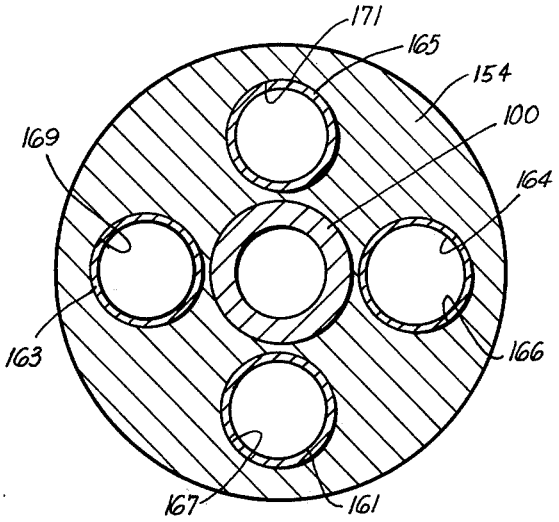
FIG. 6 is a section view along line 6—6 of FIG. 1B, illustrating the four longitudinal bores in which the pump pistons are received.

Returning now to the description of the components of the first piston assembly 112, a lower cylindrical portion 162 of piston assembly 112 is closely received within a cylinder sleeve 164, which cylinder sleeve 164 is disposed within an axial bore 166 of valve body 154 (See FIGS. 1B and 6). The other three piston assemblies are similarly received in cylinder sleeves 161, 163 and 165 in bores 167, 169 and 171.

Disposed about piston assembly 112 at the upper end of valve sleeve 164 and valve body 154 is a piston alignment sleeve 170.

The lower end of piston assembly 112 includes a reduced diameter axial extension 172 about which is disposed an annular sealing cup or wiper ring 174, which includes a lip for sealingly engaging cylinder sleeve 166. A retainer washer 176 is placed over the lower end of extension 172 and overlaps with wiper ring 174. A retainer bolt 178 threadedly engages an internal bore of extension 172 so as to hold retaining ring 176 and wiper ring 174 in place.

An annular O-ring seal 179 is disposed in an annular groove in the outer surface 162 of piston assembly 112 to provide a fluid tight sealing engagement between piston assembly 112 and cylinder sleeve 164.

The pump components located above O-ring seals 179 of the piston assemblies are batched in lubricating fluid communicated from annular cavity 34 through annular cavity 177 located between release mandrel 100 and torque mandrel 58. This lubricating fluid is contained between the annular floating seal means 38 and the piston O-ring seals 179.

Figure 7:
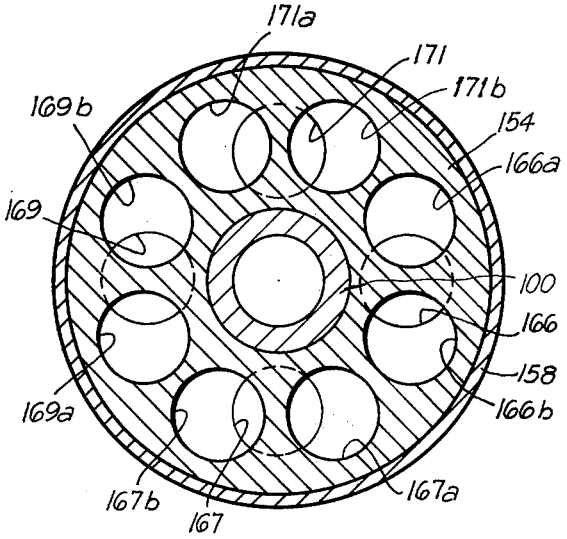
FIG. 7 is a section view along line 7—7 of FIG. 1B, illustrating the valve bores within which the inlet and outlet poppet valves are located.

Cylinder sleeve 164 includes a lower inner bore 181. Associated with first piston assembly 112 are an inlet poppet valve and an outlet poppet valve assembly. Each of the three other piston assemblies also includes a separate inlet poppet valve and a separate outlet poppet valve. The inlet and outlet poppet valves corresponding to piston bore 166 are located in valve bores designated 166*a* and 166*b*, respectively, in valve body 154 as shown in FIG. 7. Similarly, valve bores corresponding to the other piston bores 167, 169 and 171 are designated with similar suffixes.

On the left side of FIG. 1B a sectional elevation view of an inlet poppet valve assembly 182 is shown in conjunction with piston assembly 116. On the right side of FIG. 1B, a sectional elevation view of an outlet poppet valve assembly 184 is shown in conjunction with piston assembly 112.

Inlet poppet valve assembly 182 includes an upper inlet poppet retainer assembly 186, an inlet poppet base member 188, and an inlet poppet spacer member 190.

Inlet poppet retainer 186 includes a port means 192 therethrough which communicates with lower inner bore 180 of piston assembly 116. Inlet poppet base member 188 includes an inlet poppet seat 194 for sealingly engaging inlet poppet 196. An inlet poppet string 198 engages inlet poppet 196 and a downward facing shoulder 200 of inlet poppet retainer assembly 186, so that inlet poppet 196 is resiliently urged into sealing engagement with inlet poppet seat 194.

Inlet poppet base 188 includes an inner bore 202 which communicates with inner bore 192 of inlet poppet retainer 186 when inlet poppet 196 is in the open position, i.e. when inlet poppet 196 is raised above inlet poppet seat 194.

Inlet poppet spacer member 190 includes an axial blind bore 204 communicating with bore 202 of inlet poppet base 188. Inlet poppet spacer member 190 also includes a radial bore 206 therethrough intersecting with axial bore 204. An annular groove 208 is located in the outer surface of spacer member 190 and also communicated with radial bore 206. Through annular groove 208 the radial bore 206 communicates with an annular cavity 210 located between a lower radially inner cylindrical extension 212 of valve body 154 and the outer surface of release mandrel 100.

As will further be explained below, the annular cavity 210 communicates through a plurality of annular cavities with a screen through which well fluid is drawn. The well fluid drawn through the screen and the annular cavities to the intake poppet valve assembly 182 is drawn into the inner bore of the cylinder sleeve 169 of piston assembly 116 on the upward intake stroke of piston 116. On the downward stroke of piston 116 the well fluid is forced through a second series of passages down to the packers as described below.

The operation of the outlet poppet valve will now be described with regard to the outlet poppet valve assembly 184 illustrated in conjunction with piston assembly 112.

Outlet poppet valve assembly 184 includes an outlet poppet valve base 214, an outlet poppet valve retainer assembly 216 and an outlet poppet valve spacer member 218.

Outlet poppet valve base 214, retainer assembly 216, and spacer member 218 include axial bores 220, 222, and 224, respectively.

An outlet poppet 226 is resiliently urged into sealing engagement with outlet poppet seal 228 by outlet poppet valve spring 230. When the piston assembly 112 is moving upwards on its suction stroke the outlet poppet 226 is held in sealing engagement against seat 228 by spring 230 so that fluid cannot flow through outlet poppet valve assembly 184 into the cylinder of piston assembly 112. During that intake stroke fluid is flowing into the cylinder of piston assembly 112 through an inlet poppet valve assembly disposed in valve bore 116*a* similar to inlet poppet valve assembly 182.

On the downward stroke of piston assembly 112 fluid is forced from the cylinder 166 of piston assembly 112 downward through outlet poppet valve assembly 184 to an annular cavity 232 defined between valve casing 158 and a valve mandrel 234.

The valve mandrel 234 includes a radially outward projecting ledge 236, below which is located an outer cylindrical surface 238 of valve mandrel 234. Between cylindrical surface 238 and an inner cylindrical surface 240 of valve casing 158 there is defined an annular chamber 242 communicating with chamber 232. Within annular chamber 242 there is disposed a master outlet check valve assembly generally designated by the numeral 244. Master outlet check valve assembly 244 consists of a plurality of alternating annular sealing rings 246 and annular separator rings 248. The master outlet check valve assembly 244 provides a second check valve downstream of all of the outlet poppet valve assemblies 184 which prevents fluid from flowing back to the cylinders of the various piston assemblies from the packers which are located at a lower point on the drill string.

An annular cavity 250 is defined between an inner bore of valve mandrel 234 and an outer surface of release mandrel 100. Cavity 250 communicates with the cavity 210 located between valve body 154 and release mandrel 100.

Valve mandrel 234 includes a plurality of radially inward projecting splines 252 which mesh with a plurality of radially outward projecting splines 254 of release mandrel 100 so that relative axial movement between release mandrel 100 and valve mandrel 234 is permitted while rotational movement therebetween is prevented.

Figure 1C:
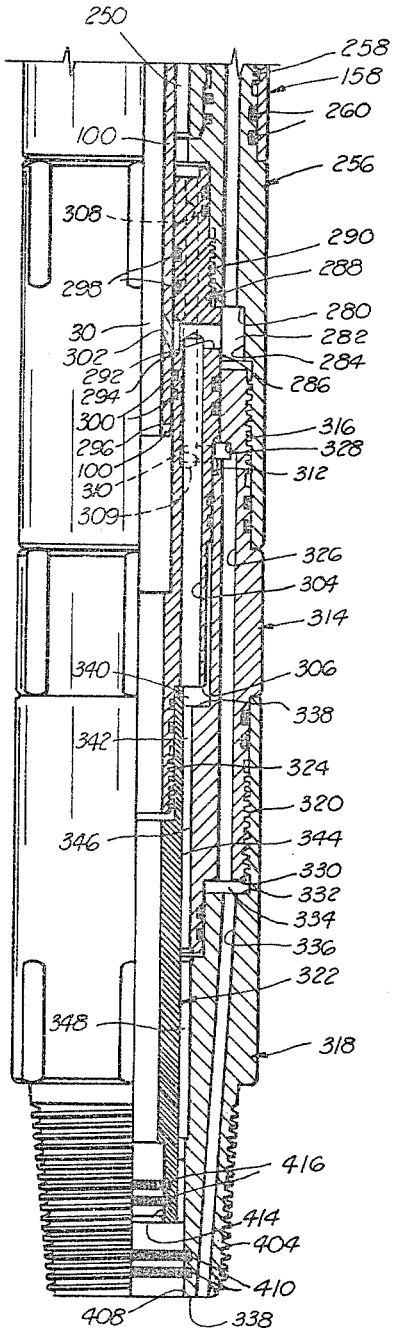

A lower end of valve casing 158 is connected to discharge adapter 256 at threaded connection 258 (See FIGS. 1B and 1C). A fluid tight seal is provided between valve casing 158 and discharge connector 256 by means of annular O-rings seals 260.

Discharge adapter 256 includes an upper axial extension 262 having a radially inward projecting flange 264 at the uppermost end thereof. The flange 264 engages and supports the lowermost annular sealing ring 246 of master outlet check valve assembly 244. A central axial bore 266 through flange 264 is closely received about outer cylindrical surface 238 of valve mandrel 234. The outer surface of axial extension 262 is spaced inward from inner cylindrical surface 240 of valve casing 158 so as to define an annular chamber 268 therebetween. Annular chamber 268 communicates with the annular chamber 242 between valve mandrel 234 and valve casing 158.

Axial extension 262 of discharge adapter 256 includes an axial bore 270 which is spaced radially outward from outer surface 238 of valve mandrel 234 so as to define an annular chamber 272 therebetween. The annular chamber 272 is communicated with the annular chamber 268 by means of a plurality of radial bores 274 disposed through axial extension 262.

Discharge adapter 256 includes a plurality of longitudinal bores 276. A short radial bore 278 communicates longitudinal bore 276 with annular cavity 272. The lower end of bore 276 communicates with a downward facing shoulder 280 of discharge adapter 256 (See FIG. 1C).

An annular cavity 282 is defined between inner cylindrical surface 284 of discharge adapter 256 and an outer cylindrical surface 286 of a relief housing 288. Relief housing 288 is threadedly connected to discharge adapter 256 at threaded connection 290 located above downward facing shoulder 280.

A radial bore 292 is disposed through relief housing 288 and communicates cavity 282 with an inner annular recess 294 of relief housing 288.

An inner cylindrical surface 296 of relief housing 288 includes a plurality of annular grooves which contain a pair of upper O-ring seals 298 and a pair of lower O-ring seals 300, which provide fluid tight sealing engagement between inner cylindrical surface 296 and the outer surface of release mandrel 100 above and below annular groove 294.

When release mandrel 100 is in a first position as illustrated in FIG. 1C, a relief port 302, disposed through the wall of release mandrel 100 communicates with annular groove 294 of relief housing 288 so as to provide fluid communication between annular groove 294 and inner bore 30 of release mandrel 100. When the relief port 302 is in registry with inner annular recess 294, thereby providing communication of the exhaust fluid from the pumping system to the inner bore 30, the discharge pressure of the pumping system is relieved into the inner bore 30 and it is not possible for the packers located below relief bore 302 to be inflated.

When it is desired to inflate the packers, the ratchet mandrel 22 is rotated relative to the ratchet case 68 so that the ratchet blocks 76 cause the release mandrel 100 to be moved axially downwards to a second position relative to relief housing 288 and relief port 302 is moved downward out of communication with annular recess 294 so that there is no longer communication between recess 294 and the inner bore 30 of release mandrel 100.

The ratchet blocks 76, the threaded outer surface 80 of ratchet mandrel 22, and inner cylindrical surfaces 72 and 90 of torque mandrel 58 may be generally characterized as a screw jack means for moving release mandrel 100 from its said first position to its said second position upon relative rotational movement between ratchet mandrel 22 and ratchet case 68.

Enlarged diameter inner surface 90 of torque mandrel 58 serves as a release means for disengaging ratchet blocks 76 from ratchet mandrel 22 after release mandrel 100 is moved to its said second position.

Radial bore 292 also communicates with the upper end of a longitudinal bore 304 disposed in relief housing 288. The lower end of longitudinal bore 304 communicates with a downward facing shoulder 306 of relief housing 288.

Relief housing 288 includes a second longitudinal blind bore 308 having an upper end communicating with annular cavity 250. A lower blind end 309 of second bore 308 communicates with a second radial bore 310 which communicates with an outer cylindrical surface 312 of relief housing 288.

The lower end of discharge adapter 256 is threadedly connected to a suction nipple 314 at threaded connection 316. The lower end of suction nipple 314 is threadedly connected to a lower adapter 318 at threaded connection 320.

The lower end of relief housing 288 is threadedly connected to an inner receiver 322 at threaded connection 324.

Suction nipple 314 includes a longitudinal bore 326, the upper end of which is communicated with radial bore 310 of relief housing 288 by radial bore 328. The lower end of longitudinal bore 326 communicates with a downward facing shoulder 330 of suction nipple 314.

Downward facing shoulder 330 is longitudinally spaced a short distance from an upward facing shoulder 332 of lower adapter 318 so as to define an annular cavity 334 between said downward and upward facing shoulders 330 and 332.

Annular cavity 334 communicates with a bore 336 of lower adapter 318, which bore 336 is slightly skewed from a longitudinal axis of lower adapter 318. The lower end of bore 336 communicates with a lower end surface 338 of lower adapter 318.

The downward facing shoulder 306 of relief housing 288 is longitudinally spaced a short distance from an upward facing shoulder 338 of suction nipple 314 so as to define an annular cavity 340 therebetween. Annular cavity 340 communicates with an annular space 342 defined between an outer surface 344 of inner receiver 322 and an inner surface 346 of suction nipple 314. The annular cavity 342 in turn communicates with an annular cavity 348 defined between the outer surface 344 of inner receiver 322 and an inner surface of lower adapter 318.

Bearing retainer 132, piston housing 146, valve body 154, valve casing 158, discharge adapter 256, suction nipple 314, and lower adapter 318 may be collectively referred to as a cylindrical pump housing and along with the various components located therein may be referred to as a pump housing assembly.

Figure 2A:
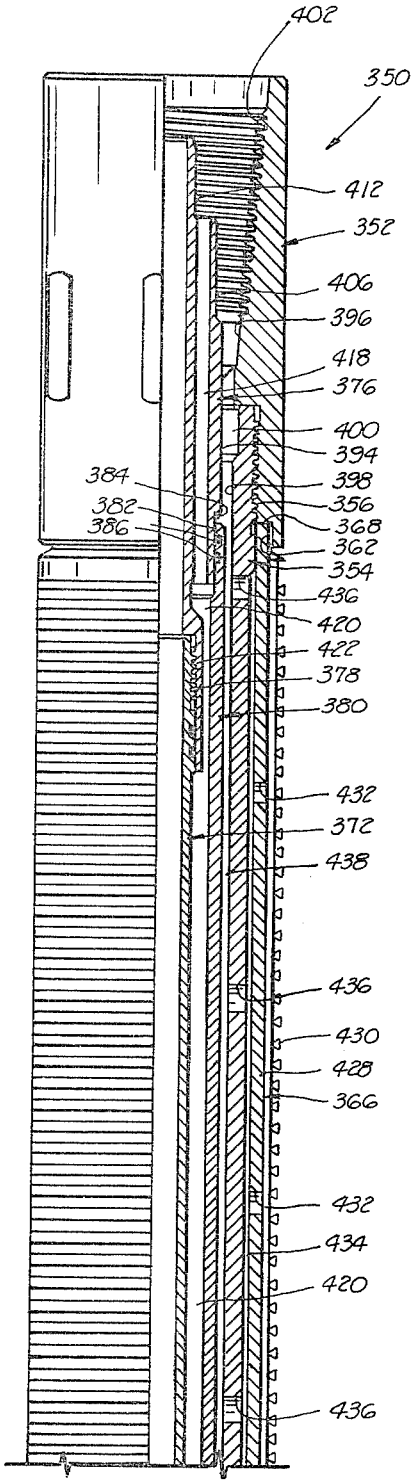
Figure 2B:
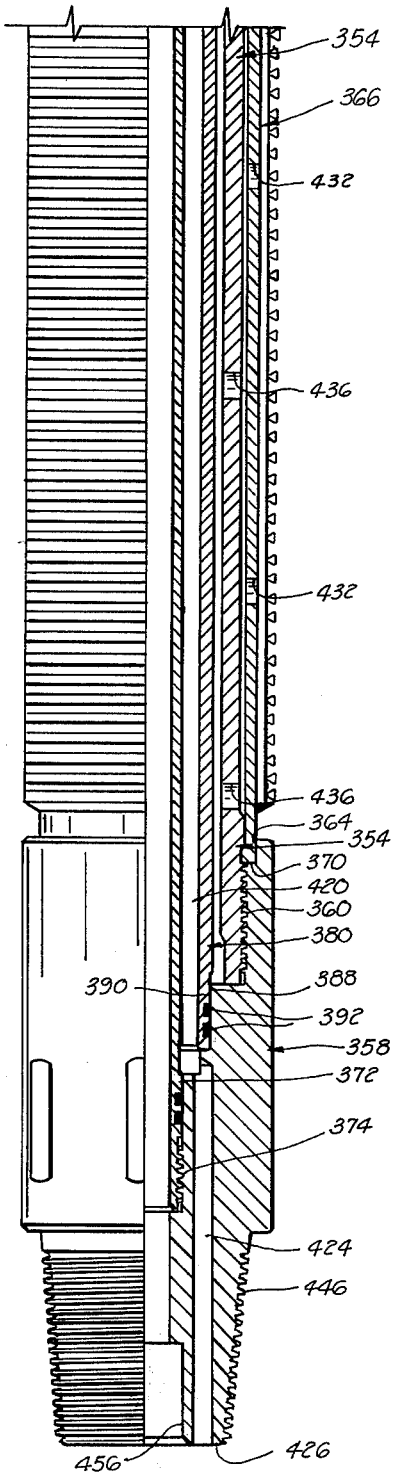

Referring now to FIG. 2A, a screen assembly generally designated by the numeral 350 is illustrated. The screen assembly 350 includes a top screen assembly adapter 352 having an internal tapered thread for connection with the external tapered thread of lower adapter 318 of the down hole pump assembly 10.

The lower end of top adapter 352 is connected to screen mandrel 354 at threaded connection 356. The lower end of screen mandrel 354 is connected to a lower screen assembly adapter 358 at threaded connection 360 (See FIG. 2B).

The lower end surface of upper screen assembly adapter 352 includes an inner annular groove 362. The upper end surface of lower screen assembly adapter 358 includes an inner annular groove 364.

A pump screen 366 is disposed about screen mandrel 354 and includes upper and lower ends 368 and 370, which are retained in annular grooves 362 and 364 of upper adapter 352 and lower adapter 358, respectively.

Threadedly connected to a lower internal bore of lower screen assembly adapter 358 is an inner mandrel 372 which is connected to lower adapter 358 at threaded connection 374.

The upper end of inner mandrel 372 is connected to a seal mandrel 376 at threaded connection 378.

A flow tube 380 has an upper end which includes an inner bore 382 which sealingly engages an outer cylindrical surface 384 of seal mandrel 376 by means of annular O-ring seals 386. The lower end of flow tube 380 includes a cylindrical outer surface 388 which sealingly engages a cylindrical inner surface 390 of lower screen assembly adapter 358 by means of annular sealing rings 392.

Seal mandrel 376 includes a central outer surface 394 which is spaced radially inward from an inner surface 396 of upper screen assembly adapter 352 and an inner bore 398 of screen mandrel 354 to define an annular cavity 400.

When screen assembly 350 is made up with down hole pump assembly 10 an internal threaded portion 402 of upper screen assembly adapter 352 is made up with an outer threaded portion 404 of lower pump assembly adapter 318. When threaded portions 402 and 404 are so made up, a cylindrical outer surface 406 of seal mandrel 376 is closely received within an internal bore 408 of lower pump assembly adapter 318, and a fluid tight seal is provided therebetween by a plurality of annular sealing rings 410.

A second cylindrical outer surface 412 of seal mandrel 376 is closely received within a lower inner bore 414 of inner receiver 322 and a fluid tight seal is provided therebetween by sealing rings 416.

When the threaded joint is made up between threads 402 and 404 and the fluid tight seals 410 and 416 are engaged as described, fluid communication is provided between bore 336 of lower pump assembly adapter 318 and annular cavity 400 so that intake well fluid drawn into the screen assembly, as will be further described below, is directed upwards through annular cavity 400 into bore 336 and upward through the various other passages previously described to the suction inlet poppet valves of the piston assemblies.

The annular cavity 348 between inner receiver 322 and lower pump assembly adapter 318 is similarly placed in fluid communication with a longitudinal bore 418 of seal mandrel 376, so that pressurized well fluid from the outlet side of the piston assemblies may be passed from annular cavity 348 into bore 418 and onward to the packers to inflate the same as will be described below. Preferably there are a plurality of the longitudinal bores 418 radially spaced within seal mandrel 376. The lower ends of bores 418 communicate with an annular cavity 420 formed between the inner bore of flow tube 380 and outer cylindrical surfaces of a lower seal mandrel extension 422 and inner mandrel 372. The lower end of cavity 420 communicates with a longitudinal bore 424 of lower screen assembly adapter 358. The lower end of bore 424 communicates with the bottom surface 426 of lower screen assembly adapter 358.

Pump screen 366 includes a tubular screen support member 428 about which is disposed a tubular filter member 430. Tubular screen support member 428 includes a plurality of radial bores 432 so that well fluid may flow radially inward through filter 430 then through the radial bores 432 into an annular space 434 between tubular screen support member 428 and screen mandrel 354.

A plurality of radial bores 436 are disposed through screen mandrel 354 to provide fluid communication between annular cavity 434 and an annular cavity 438 between screen mandrel 354 and flow tube 380.

The well fluid which flows through filter 430, the radial bores 432, the annular cavity 434, the radial bores 436 and into the annular cavity 438 then flows upward through annular cavity 438 into annular cavity 400 and upwards into bore 336 of lower pump assembly adapter 318 and further upward to the suction valve of the piston assemblies.

Figure 3A:
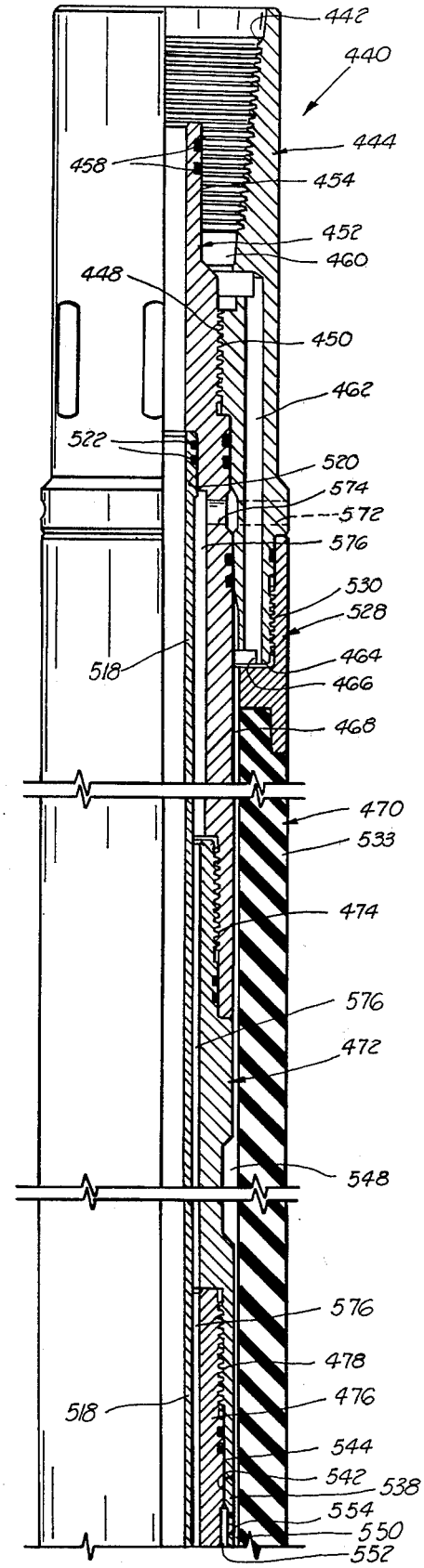
Figure 3B:
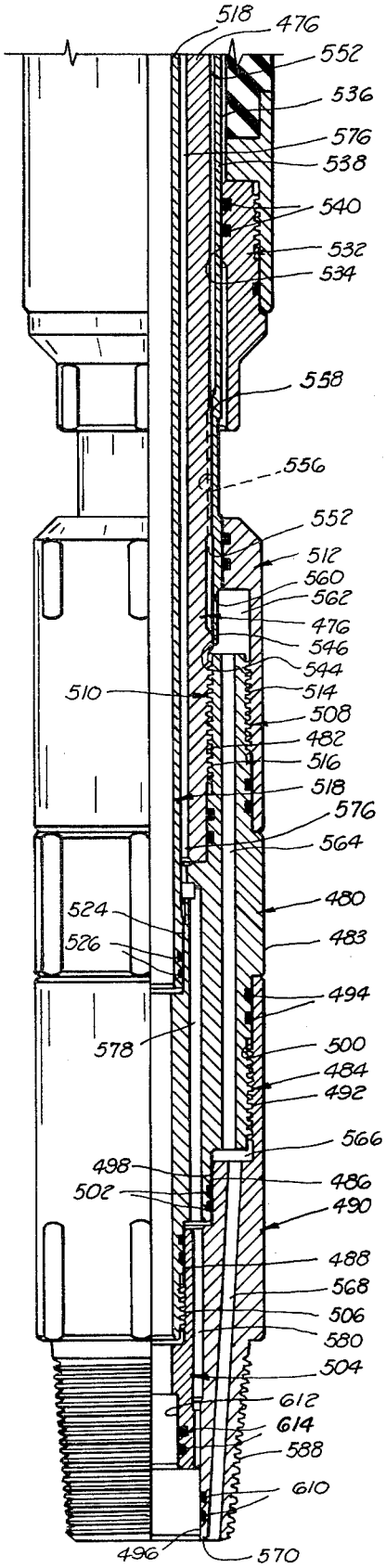

Connected to lower screen assembly adapter 358 is an upper packer assembly generally designated by the numeral 440 (See FIG. 3A). An internal tapered thread 442 of an upper packer shoe 444 of upper packer 440 connects to an outer tapered thread 446 of lower screen assembly adapter 358.

Upper shoe 444 includes an intermediate threaded internal bore 448 which is threadedly engaged with an outer threaded portion 450 of a bypass mandrel 452.

Bypass mandrel 452 has an upper cylindrical outer surface 454 which is closely received within an inner bore 456 of lower screen assembly adapter 358 when the threaded connection is made up between lower screen assembly adapter 358 and upper shoe 444. A fluid tight seal is provided between bore 456 and outer surface 454 by means of a plurality of O-ring seals 458 disposed in grooves in the surface 454.

When lower screen assembly adapter 358 is made up with upper shoe 444 the longitudinal bore 424 of lower screen assembly adapter 358 is in fluid communication with an annular cavity 460 defined between bypass mandrel 452 and upper shoe 444.

Upper shoe 444 includes a longitudinal bore 462, the upper end of which communicates with annular cavity 460 and the lower end of which communicates with lower end surface 464 of upper shoe 444. Lower end surface 464 includes an annular recess 466 communicating with bore 462. The annular recess 466 in turn communicates with annular cavity 468 defined between bypass mandrel 452 and an inflatable bladder means 470.

Threadedly connected to the lower end of bypass mandrel 452 at threaded connection 474, is packer mandrel adapter 472. The lower end of packer mandrel adapter 472 is in turn connected to packer mandrel 476 at threaded connection 478. The lower end of packer mandrel 476 is connected to flow connector 480 at threaded connection 482 (See FIG. 3B).

Flow connector 480 includes a central outer cylindrical surface 483, a first lower reduced diameter outer surface 484, a second lower further reduced diameter outer surface 486, and a third lower further reduced diameter surface 488.

Threadedly connected to the first lower reduced diameter surface 484 of flow connector 480 at threaded connection 492 is a lower packer adapter 490. A fluid tight seal between lower packer adapter 490 and flow connector 480 above the threaded connection 492 is provided by sealing rings 494.

Lower packer adapter 490 include a central axial bore 496, a first upper counterbore 498, and a second upper counterbore 500. It is the second upper counterbore 500 which includes part of the threaded connection 492.

The first counterbore 498 of lower packer adapter 490 is closely received about second reduced diameter surface 486 of flow connector 480 and a fluid tight seal therebetween is provided by seals 502.

Connected to the lower end of flow connector 480 at threaded connection 506 is an inner packer receiver 504.

Flow connector 480 also includes an upper reduced diameter outer surface 508 and an upper central bore 510.

A flow connector cap 512 is connected to upper reduced diameter surface 508 of flow connector 480 at threaded connection 514.

A lower end of packer mandrel 476 is connected to the central upper bore 510 of flow connector 480 at threaded connection 516.

A packer flow tube 518 is located concentrically inward of packer mandrel 476 and its upper end is closely received within an inner bore 520 of bypass mandrel 452, and a fluid tight connection therebetween is provided by seals 522. The lower end of packer flow tube 518 is closely received within a central inner bore 524 of flow connector 480 and a fluid tight seal therebetween is provided by seals 526.

The inflatable bladder means 470 includes an annular anchor ring 528 connected to upper shoe 444 at threaded connection 530. An inflatable element 533 of inflatable bladder means 470 is connected between anchor ring 528 at its upper end and a floating shoe assembly 532 at its lower end. Floating shoe assembly 532 includes a central inner bore 534 which slidingly engages an outer cylindrical surface 536 of a mandrel cover tube 538. Fluid tight sealing engagement is provided between sliding shoe 532 and cover tube 538 by means of sealing rings 540. The upper end of cover tube 538 includes a central bore 542 which is closely received about an outer surface 544 of packer mandrel 476. The lower end of cover tube 538 includes a central bore 544 which is closely received about a cylindrical ledge extension 546 of packer mandrel 476.

The high pressure fluid from the discharge of the piston assemblies, when introduced into the small annular cavity 468 through annular cavity 460, longitudinal bore 462, and annular recess 466 as previously described, will cause the inflatable element 533 of inflatable bladder means 470 to be inflated and thereby pack off annular cavity 21 between the packer and the well bore or the well casing within which it is located. The high pressure inflation fluid passes on downward through annular cavity 468 to an annular cavity 548 between packer mandrel 472 and the inflatable bladder means 470, then into annular cavity 550 between cover tube 538 and the annular bladder means 470.

Cover tube 538 is spaced radially outward from packer mandrel 476 so as to define an annular cavity 552. A radial bore 554 through cover tube 538 places annular cavities 550 and 552 in fluid communication. As will be seen from the further description below, the fluid which passes from annular cavity 550 through radial bore 554 into annular cavity 552 will be further directed downward through the drill string to a second lower packer assembly 662 located below upper packer assembly 440.

Cover tube 538 includes a plurality of radially inward projecting lugs or splines 556 which mesh with a plurality of radially outward projecting lugs or splines 558 of packer mandrel 476 so as to prevent the cover tube 538 from rotating relative to packer mandrel 476.

At the lower end of cover tube 538 there is a second radial bore 560 disposed therethrough which communicates annular cavity 552 with an annular cavity 562 defined between the outer surface of cover tube 538 and a cylindrical inner surface of flow connector cap 512.

Flow connector 480 includes a longitudinal bore 564 disposed therethrough, the upper end of which communicates with annular cavity 562 and the lower end of which communicates with an annular cavity 566 defined between flow connector 480 and lower packer adapter 490. Lower packer adapter 490 in turn includes a skewed bore 568 the upper end of which communicates with annular cavity 566 and the lower end of which communicates with a bottom surface 570 of lower packer adapter 490.

The upper packer assembly 440 also includes a means for bypassing well fluid located outside the packer from a point above the upper packer 440 to a point below the lower packer 662. The upper shoe 444 includes a bypass inlet bore 572 disposed radially therethrough which communicates with a radial bore 574 of bypass mandrel 452. Radial bore 574 communicates with an annular cavity 576 defined between packer flow tube 518 and bypass mandrel 452, packer mandrel adapter 472, packer mandrel 476 and flow connector 480. The annular cavity 576 located about packer flow tube 518 continues downward to near the lower end of packer flow tube 518 where it is communicated with a second longitudinal bore 578 of flow connector 480. The lower end of second longitudinal bore 578 in turn communicates with an annular cavity 580 defined between an outer cylindrical surface of inner packer receiver 504 and an inner cylindrical surface lower packer adapter 490.

Figure 4A:
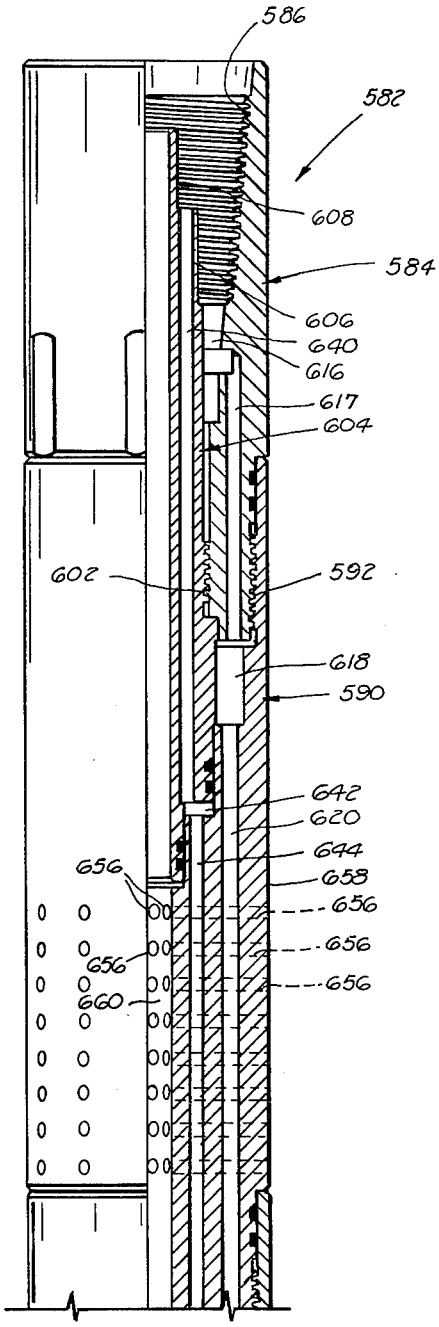
Figure 4B:
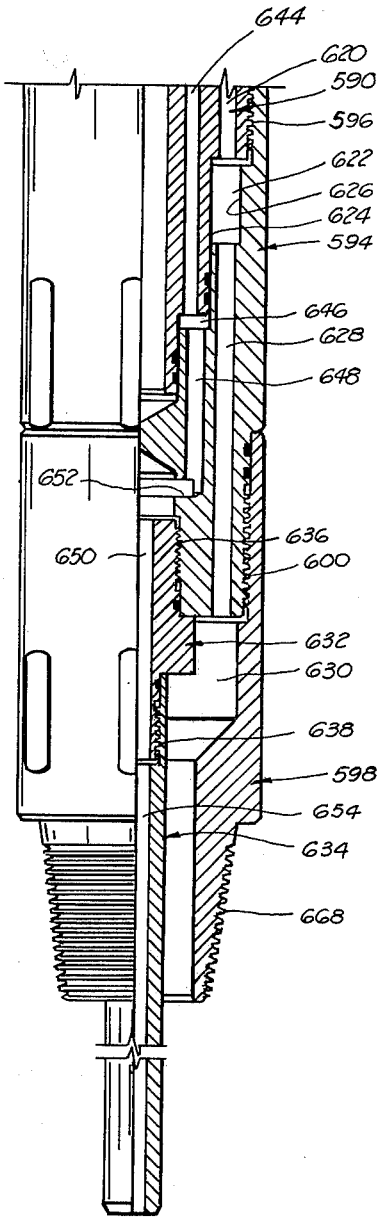

Connected to the lower end of first packer assembly 440 is an intake port assembly generally designated by the numeral 582 (See FIG. 4A).

Intake port assembly 582 includes a top port assembly adapter 584, which includes an internal thread 586 for connection with an external thread 588 of lower packer adapter 490. The lower end of top port assembly adapter 584 is connected to a port adapter 590 at threaded connection 592. The lower end of port adapter 590 is connected to a spacer connector 594 at threaded connection 596 (See FIG. 4B). The lower end of spacer connector 594 is connected to a lower port assembly adapter 598 at threaded connection 600.

Top port assembly adapter 584 includes an internal threaded portion 602 which is threadedly connected to a port assembly seal mandrel 604.

Port assembly seal mandrel 604 includes a first upper reduced diameter outer surface 606 and a second upper reduced diameter outer surface 608.

When top port assembly adapter 584 is connected to lower packer assembly adapter 490 by making up threads 586 and 588, the first reduced diameter upper surface 606 is closely received within bore 496 of lower packer assembly adapter 490 and a fluid tight seal therebetween is provided by seal 610. Similarly, the second upper reduced diameter surface 608 is closely received within bore 612 of inner packer receiver 504 and a fluid tight seal therebetween is provided by seals 614.

When upper port assembly adapter 584 is connected to lower packer adapter 490, the bore 568 of lower packer adapter 490 is communicated with an annular cavity 616 between port assembly seal mandrel 604 and top port assembly adapter 584. Top port assembly adapter 584 in turn includes a longitudinal bore 617 the upper end of which is communicated with annular cavity 616 and the lower end of which is communicated with an annular cavity 618 between port assembly seal mandrel 604 and port adapter 590.

Annular cavity 618 is in fluid communication with an upper end of a longitudinal bore 620 disposed through port adapter 590. The lower end of bore 620 communicates with an annular cavity 622 defined between an outer surface 624 of a lower reduced diameter portion of port adapter 590 and an inner cylindrical surface 626 of spacer connector 594.

Spacer connector 594 includes a longitudinal bore 628 the upper end of which communicates with annular cavity 622 and the lower end of which communicates with an irregular annular cavity 630 defined between inner surfaces of lower port assembly adapter 598 and outer surfaces of a bypass adapter 632 and bypass stinger 634.

Bypass adapter 632 is connected to spacer connector 594 at threaded connection 636. Bypass stinger 634 is connected to bypass adapter 632 at threaded connection 638.

When top port assembly adapter 584 is connected to lower packer assembly adapter 490 the annular cavity 580 is in fluid communication with a longitudinal bore 640 of port assembly seal mandrel 640. The lower end of bore 640 communicates with an annular cavity 642 between port assembly seal mandrel 604 and port adapter 590.

The annular cavity 642 is in fluid communication with the upper end of a second longitudinal bore 644 of port adapter 590. The lower end of longitudinal bore 644 communicates with an annular cavity 646 defined between port adapter 590 and spacer connector 594.

Annular cavity 646 in turn communicates with the upper end of a second longitudinal bore 648 of spacer connector 594.

The lower end of a second longitudinal bore 648 communicates with a central bore 650 of bypass adapter 632 by means of a radial bore 652. The central bore 650 communicates with a central bore 654 of bypass stinger 634.

Port adapter 590 includes a multitude of radially extending ports 656 communicating an outer surface 658 of port adapter 590 with a central bore 660 of port adapter 590. Test fluid from the zone of the subsurface formation which is to be tested between the upper and lower packer assemblies 440 and 662 is drawn in through the ports 656 in to the central bore 660 and the flows upwards through the central bores of the various components already described and upward through the drill string to the surface of the earth.

Figure 5A:
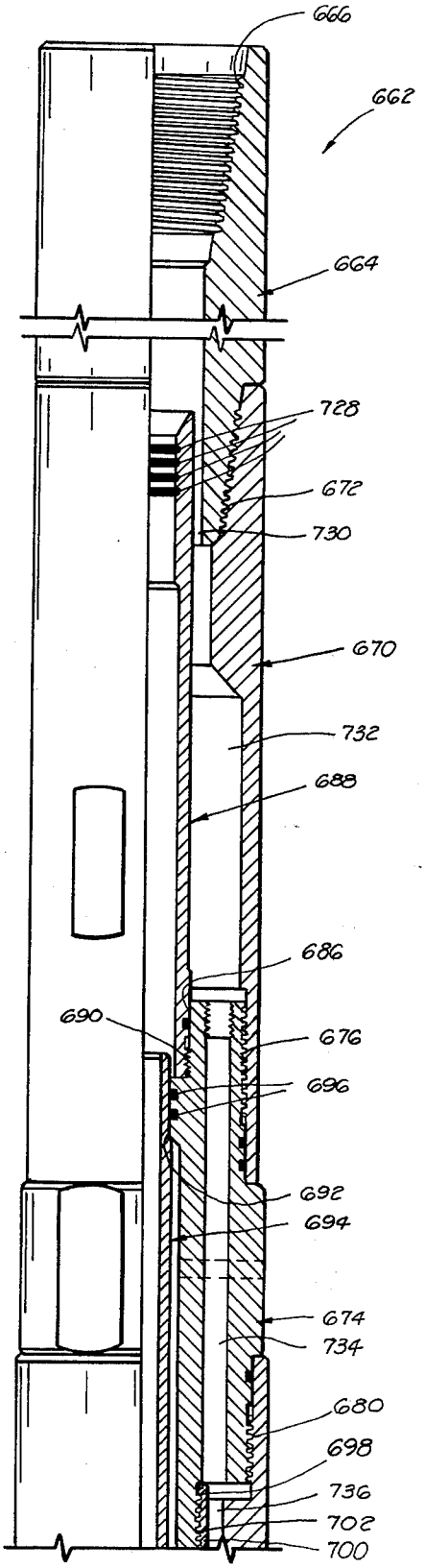
Figure 5B:
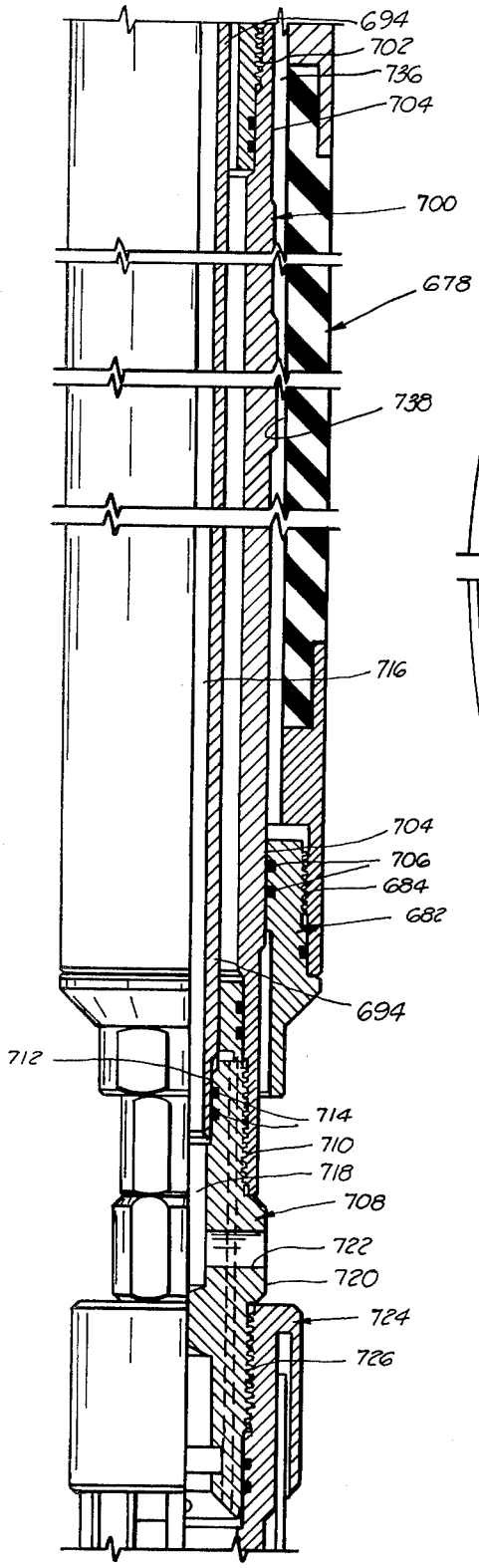
Figure 5C:
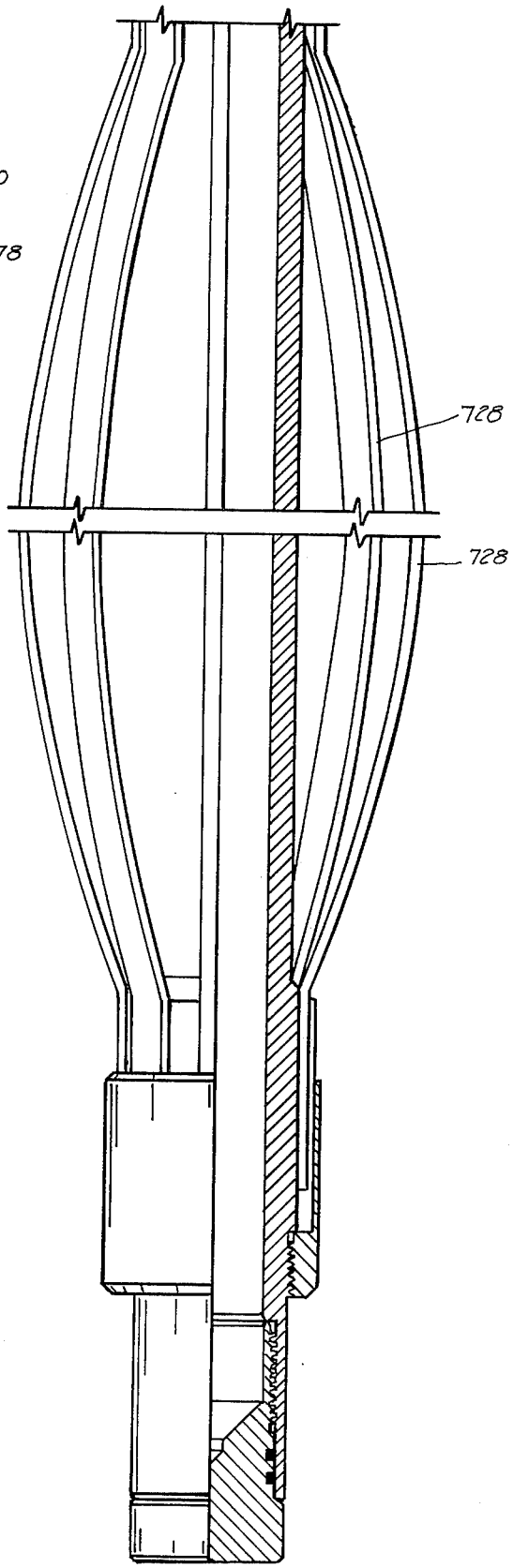

Connected below intake port assembly 582 is a lower packer assembly generally designated by the numeral 662 (See FIG. 5A). The lower packer assembly 662 includes a top adapter 664 which has an internal threaded portion 666 which engages an external thread 668 of lower port assembly adapter 598.

The lower end of top adapter 664 is connected to a spacer member 670 at threaded connection 672. The lower end of spacer member 670 is in turn connected to a connector body 674 at threaded connection 676.

The lower end of connector body 674 is connected to an upper end of a second lower inflatable bladder means 678 (See FIG. 5B) at threaded connection 680. The lower end of inflatable bladder means 678 is connected to a sliding shoe assembly 682 at threaded connection 684.

Connector body 674 includes an upper inner cylindrical bore 686 to which is connected a bypass receiver 688 at threaded connection 690.

Closely received within a central inner bore 692 of connector body 674 is the upper end of an equalizer tube 694 and a sealing engagement is provided therebetween by O-rings 696.

A lower second reduced diameter cylindrical surface 698 of connector body 674 is connected to a lower packer mandrel 700 at threaded connection 702.

The sliding shoe 682 of inflatable bladder means 678 is slidingly received upon an outer cylindrical surface 704 of packer mandrel 700, and a fluid tight seal therebetween is provided by O-rings 706.

The lower end of packer mandrel 700 is connected to an equalizer port body 708 at threaded connection 710. The lower end of equalizer tube 694 is closely received within an internal bore 712 of equalizer port body 708 and a fluid tight seal therebetween is provided by O-rings 714.

A central bore 716 of equalizer tube 694 communicates with a central bore 718 of equalizer port body 708. The central bore 718 is in turn communicated with an outer surface 720 of equalizer port body 708 by a radial bore 722. The radial bore 722 thereby provides fluid communication to the annular area outside the second packer assembly 662 below the second inflatable bladder means 678. In that manner fluid pressure in the annulus between the drill string and the well casing is equalized from a point below second inflatable bladder means 678 to a point at radial port 572 above first inflatable bladder means 470.

The lower end of equalizer port body 708 is connected to a drag spring body 724 at threaded connection 726. A plurality of drag springs 728 (See FIG. 5C) are connected to drag spring body 724. The drag springs 728 resiliently engage the inner surface of the well casing or of the well bore to prevent rotation of the packer assemblies 440 and 662 relative to the well casing or well bore.

When top adapter 664 of second packer 662 is connected to lower port assembly adapter 598, the bypass stinger 634 is closely received within bypass receiver 688 and a fluid tight seal is provided therebetween by O-rings 728.

The annular cavity 630 communicates with an annular cavity 730 defined between bypass receiver 688 and top adapter 664.

Annular cavity 730 in turn communicates with an annular cavity 732 defined between bypass receiver 688 and spacer member 670.

Annular cavity 732 communicates with the upper end of a longitudinal bore 734 of connector body 674. The lower end of longitudinal bore 734 communicates with an annular cavity 736 defined between the outer surface 704 of packer mandrel 700 and an inner surface 736 of inflatable bladder means 678.

Pressurized well fluid directed from the piston assemblies enters annular cavity 736 to inflate the second inflatable bladder means 678.

As is shown in FIG. 8, when the first and second inflatable bladder means, 470 and 678, of first and second packer assemblies, 440 and 662, respectively, are inflated they engage well hole 19 and isolate a zone 740 of the subterranean formation so that a sample of the fluid produced from that zone 740 may be drawn into intake port assembly 582 to test the production of zone 740.

Thus, the down hole pump and testing apparatus of the present invention is well adapted to obtain the ends and advantages mentioned, as well as those inherent therein. While presently preferred embodiments of the invention have been described for the purpose of this disclosure, numerous changes in the construction and arrangement of parts can be made by those skilled in the art, which changes are encompassed within the scope and spirit of this invention as defined by the appended claims.

What is claimed is:

1. A downhole pump assembly, comprising:

a top adapter means for threadedly attaching said pump assembly to an upper portion of a pipe string;

a ratchet mandrel, connected to an inner cylindrical surface of a lower end of said top adapter means;

a cylindrical torque adapter connected to an outer cylindrical surface of said lower end of said top adapter means;

a cylindrical torque housing, having an upper end connected to a lower end of said torque adapter and including a radially inward projecting annular flange at a lower end thereof;

a torque mandrel, having an upper end extending into a lower end of said torque adapter and including a downward facing annular shoulder with a plurality of splines extending radially outward adjacent said shoulder, said shoulder engaging in an upper surface of said flange of said torque housing, and said splines engaging a plurality of radially inward projecting splines of said torque housing to prevent relative rotational motion between said torque mandrel and said torque housing;

a ratchet case, including a cylindrical upper end located in an annular space between said ratchet mandrel and said torque mandrel, and including a cylindrical bore within which a lower end of said ratchet mandrel is slidingly received;

a plurality of ratchet blocks, attached to an upper end of said ratchet case, said ratchet blocks including radially inner threads engaging a threaded outer surface of said ratchet mandrel and including radially outer surfaces closely engaging an upper inner cylindrical surface of said torque mandrel;

a release mandrel, having an upper end connected to a lower end of said ratchet case;

a pump housing assembly, within which a lower end of said torque mandrel is rotatingly received, said pump housing assembly including:

a cylindrical pump housing, including a lower pump housing adapter means for threadedly attaching said pump housing to a lower portion of said pipe string;

a cam driven reciprocating piston pump disposed in said cylindrical pump housing, said pump being connected to said lower end of said torque mandrel so that said pump is driven when said torque mandrel is rotated relative to said pump housing;

intake passage means, connecting a suction of said pump with a lower end of said lower pump housing adapter for communication with a suction inlet means of said lower portion of said drill string;

discharge passage means, connecting a discharge of said pump with said lower end of said lower pump housing adapter; and an inner cylindrical bore disposed in said pump housing assembly, and a relief port communicating said bore with said discharge means; and wherein a lower end of said release mandrel is closely received within said inner cylindrical bore of said pump housing assembly, and is longitudinally movable relative to said inner bore, between a first position, wherein said relief port is open to communicate said discharge passage with an inner bore of said release mandrel and a second position wherein said relief port is closed.

2. The downhole pump assembly of claim 1, wherein said torque mandrel further includes a second inner cylindrical surface located below said upper inner cylindrical surface thereof and having a diameter greater than a diameter of said upper inner cylindrical surface, said diameter of said upper inner cylindrical surface being such that so long as said radially outer surfaces of said ratchet blocks are closely engaged with said upper inner cylindrical surface said radially inner threads of said ratchet blocks are maintained in engagement with said threaded outer surface of said ratchet mandrel.

3. The downhole pump assembly of claim 2, wherein said diameter of said second inner cylindrical surface of said torque mandrel is sufficiently great that when said ratchet blocks are located within said second inner cylindrical surface said ratchet blocks may move radially outward a sufficient distance to permit said threaded outer surface of said ratchet mandrel to move downward without rotation past said radially inner threads of said ratchet blocks.

4. The downhole pump assembly of claim 3, wherein said ratchet blocks, said threaded outer surface of said ratchet mandrel, and said upper inner cylindrical surface of said torque mandrel are further characterized as being a screw jack means for moving said release mandrel from its said first position to its said second position upon relative rotational movement between said ratchet mandrel and said cylindrical pump housing.

5. The downhole pump assembly of claim 4, wherein said second inner cylindrical surface of said torque mandrel is further characterized as being a release means for disengaging said ratchet blocks from said ratchet mandrel after said release mandrel is moved to its said second position.

6. The downhole pump assembly of claim 1, wherein:

said ratchet mandrel and said cylindrical torque adapter define a longitudinally extending annular cavity therebetween and include a relief means for communicating said cavity with a well bore outside said downhole pump assembly, said well bore containing a well fluid;

said upper end of said torque mandrel is received in said annular cavity; and said downhole pump assembly further comprises an annular floating seal means, slidingly disposed in said annular cavity and located between said relief means and said upper end of said torque mandrel, for sealingly engaging radially inner and outer surfaces of said annular cavity and for separating a lubricating fluid in said annular cavity, between said floating seal means and said torque mandrel, from said well fluid.

7. The downhole pump assembly of claim 6, further comprising:

a downward facing shoulder projecting into said annular cavity for engaging said annular floating seal means and limiting longitudinal movement of said floating seal means toward said relief means; and wherein said floating seal means includes a means for allowing a portion of said lubricating fluid to flow past said floating seal means when said torque mandrel is moved longitudinally toward said floating seal means after said floating seal means is engaged with said downward facing shoulder projecting into said annular cavity.

8. The downhole pump assembly of claim 7, wherein:

said release mandrel and said torque mandrel define a second annular cavity therebetween for communicating said lubricating fluid with said cam driven reciprocating piston pump to lubricate said pump; and said cam driven reciprocating piston pump includes a rotating cam drive member attached to said lower end of said torque mandrel and a longitudinally reciprocating piston connected to said cam drive member, said piston being disposed in a longitudinal bore of said pump housing, and said pump further including an annular piston seal means between a cylindrical outer surface of said piston and an inner surface of said longitudinal bore of said pump housing, so that said lubricating fluid is contained between said floating seal means and said annular piston seal.

9. The downhole pump assembly of claim 1, further comprising a screen assembly, said screen assembly including:

a top screen assembly adapter for threadedly connecting said screen assembly to said lower pump housing adapter means;

a lower screen assembly adapter for threadedly connecting said screen assembly to the lower portion of said drill string;

a tubular member connected between said top and lower screen assembly adapters;

a screen disposed about an outer surface of said tubular member;

an intermediate discharge passage disposed in said screen assembly and communicating said dischharge passage means of said pump housing assembly with a lower end of said lower screen assembly adapter; and wherein said suction inlet means is disposed in said screen assembly and communicates said outer surface of said tubular member with said intake passage means of said pump housing assembly.

10. A downhole testing apparatus including the downhole pump assembly of claim 1, and further comprising:

a screen assembly including a top screen assembly adapter for threadedly connecting said screen assembly to said lower pump housing adapter means, said screen assembly having said suction inlet means disposed therein;

a first packer assembly, having a top first packer assembly adapter for threadedly connecting said first packer assembly to a lower end of said screen assembly, said first packer assembly including a first inflatable element communicated with said discharge passage means of said pump housing assembly through an intermediate discharge passage of said screen assembly;

an intake port assembly having a top intake port assembly adapter for threadedly connecting said intake port assembly to a lower end of said first packer assembly, said intake port assembly having a plurality of ports disposed therein for communicating an annular space between said intake port assembly and a well hole with an inner bore of said intake port assembly; and a second packer assembly, having a top second packer assembly adapter for threadedly connecting said second packer assembly to a lower end of said intake port assembly, said second packer assembly including a second inflatable element communicated with said discharge passage means of said pump housing assembly through said intermediate discharge passage of said screen assembly and second and third intermediate discharge passages in said first packer assembly and said intake port assembly, respectively, so that said first and second inflatable elements may be inflated with fluid from the discharge of said pump to isolate a zone of said well so that a sample of well fluid may be taken therefrom through said intake port assembly.

* * * * *